US007275678B2

(12) United States Patent
Hodsdon et al.

(10) Patent No.: US 7,275,678 B2
(45) Date of Patent: Oct. 2, 2007

(54) PRINTABLE ENVELOPE WITH REMOVABLE BUSINESS CARD FOR COMPACT DISCS

(75) Inventors: Jerry G. Hodsdon, Forestdale, MA (US); Heather Gareis, Los Angeles, CA (US); Daisy S. Taw, Temple City, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 10/420,666

(22) Filed: Apr. 21, 2003

(65) Prior Publication Data

US 2004/0026489 A1 Feb. 12, 2004

Related U.S. Application Data

(60) Provisional application No. 60/373,851, filed on Apr. 19, 2002.

(51) Int. Cl.
*B65D 15/00* (2006.01)
*B65D 27/00* (2006.01)

(52) U.S. Cl. ..... 229/92.8; 229/75

(58) Field of Classification Search ..... 229/92.8, 229/300, 304–305, 75, 82, 84, 301–303
See application file for complete search history.

(56) References Cited

U.S. PATENT DOCUMENTS

| | | | | |
|---|---|---|---|---|
| 174,940 | A * | 3/1876 | Brown | 229/68.1 |
| 686,260 | A | 11/1901 | Collins | |
| 686,261 | A | 11/1901 | Collins | |
| 886,449 | A * | 5/1908 | West | 229/305 |
| 1,561,454 | A * | 11/1925 | Ashby | 229/305 |
| 1,957,704 | A * | 5/1934 | Drachman | 229/305 |
| 2,686,005 | A * | 8/1954 | Hyman | 229/305 |
| 2,928,583 | A * | 3/1960 | Law | 229/305 |
| 2,986,325 | A * | 5/1961 | Loderhose | 206/312 |
| 3,131,854 | A * | 5/1964 | Deutschmeister | 229/305 |
| 3,228,586 | A | 1/1966 | Hayes | |
| 3,693,869 | A * | 9/1972 | Eaves, Jr. | 229/302 |
| 3,762,630 | A | 10/1973 | Braznell | |

(Continued)

FOREIGN PATENT DOCUMENTS

| | | |
|---|---|---|
| EP | 1157856 | 11/2001 |

(Continued)

*Primary Examiner*—Jes F. Pascua
(74) *Attorney, Agent, or Firm*—Jeffer, Mangels, Butler & Marmaro LLP

(57) ABSTRACT

A printable sheet including one or more envelope assemblies formed thereon, each having a central body panel, an end flap, a pair of opposing top and bottom panels, a business card removably attached and incorporated into the bottom panel, and a retaining flap. The sheet is capable of being placed in a printer to have images and/or indicia printed on the envelope assemblies. Each envelope assembly is capable can be removed from the printable sheet and folded along weakened lines, and adhered to itself to form a secure sleeve or envelope for holding various items. Each envelope has a retaining flap on the open end that can be tucked into the envelope after insertion of its contents in order to retain the contents, which could either be used or removed if desired. The envelope could be designed to readily hold business card compact discs. The business card can be subsequently separated by the user from the formed envelope.

10 Claims, 14 Drawing Sheets

U.S. PATENT DOCUMENTS

| | | | | | |
|---|---|---|---|---|---|
| 3,845,698 | A | | 11/1974 | Scholle | |
| 3,926,365 | A | | 12/1975 | Sandstrom | |
| 4,437,852 | A | | 3/1984 | Volk, Jr. et al. | |
| 4,708,285 | A | | 11/1987 | Segall | |
| 4,838,580 | A | * | 6/1989 | Tuhkanen | 283/56 |
| 5,050,792 | A | | 9/1991 | Segall | |
| 5,255,785 | A | * | 10/1993 | Mackey | 206/308.3 |
| 5,333,780 | A | | 8/1994 | Scott | |
| 5,348,216 | A | * | 9/1994 | Scott | 229/75 |
| 5,377,904 | A | | 1/1995 | Michlin et al. | |
| 5,501,392 | A | | 3/1996 | Kraus | |
| 5,622,390 | A | | 4/1997 | Jenkins | |
| 5,697,547 | A | | 12/1997 | Kraus | |
| 5,769,216 | A | | 6/1998 | Collins | |
| 5,836,622 | A | * | 11/1998 | Fabel | 283/62 |
| 5,887,780 | A | | 3/1999 | Popat et al. | |
| D411,402 | S | | 6/1999 | Udwin et al. | |
| 5,950,910 | A | * | 9/1999 | Petkovsek | 229/92.8 |
| 6,019,280 | A | * | 2/2000 | Peterson | 229/305 |
| 6,027,014 | A | * | 2/2000 | Cochran | 229/70 |
| 6,041,999 | A | * | 3/2000 | Petkovsek | 229/300 |
| 6,129,389 | A | | 10/2000 | Younger | |
| D434,262 | S | | 11/2000 | Bergh et al. | |
| 6,149,205 | A | | 11/2000 | Attia et al. | |
| 6,186,320 | B1 | | 2/2001 | Drew | |
| 6,220,504 | B1 | | 4/2001 | Flynn et al. | |
| 6,220,505 | B1 | | 4/2001 | Flynn | |
| 6,241,086 | B1 | | 6/2001 | Bergh et al. | |
| 6,257,624 | B1 | * | 7/2001 | Fabel | 283/62 |
| 6,267,234 | B1 | | 7/2001 | Bergh et al. | |
| 6,269,158 | B1 | | 7/2001 | Kim | |
| 6,279,817 | B1 | | 8/2001 | Flynn | |
| 6,322,106 | B1 | | 11/2001 | Mehta et al. | |
| 6,352,198 | B1 | | 3/2002 | Flynn | |
| 6,357,651 | B1 | | 3/2002 | Flynn | |
| 6,364,198 | B1 | | 4/2002 | Flynn | |
| 6,367,689 | B1 | | 4/2002 | Flynn | |
| 6,375,065 | B1 | | 4/2002 | Flynn | |
| 6,415,976 | B1 | | 7/2002 | Flynn | |
| 6,425,519 | B1 | * | 7/2002 | Flynn et al. | 229/75 |
| 6,427,905 | B1 | | 8/2002 | Flynn | |
| 6,450,399 | B1 | | 9/2002 | Attia et al. | |
| 6,488,999 | B1 | | 12/2002 | Flynn | |
| 6,493,970 | B1 | | 12/2002 | McCarthy et al. | |
| 6,499,651 | B2 | | 12/2002 | Gerrie et al. | |
| 6,499,652 | B1 | | 12/2002 | Flynn | |
| 6,523,737 | B1 | | 2/2003 | Flynn | |
| 6,559,970 | B1 | | 5/2003 | Yamamoto et al. | |
| 6,561,547 | B2 | | 5/2003 | Attia et al. | |
| 6,673,408 | B1 | * | 1/2004 | Roth | 428/40.1 |
| 6,789,725 | B2 | | 9/2004 | MacEwen et al. | |
| D500,078 | S | * | 12/2004 | Fraser et al. | D19/1 |
| 2002/0070266 | A1 | | 6/2002 | Glenn et al. | |

FOREIGN PATENT DOCUMENTS

| | | | |
|---|---|---|---|
| EP | 1224129 | | 7/2002 |
| EP | 1277190 | | 1/2003 |
| GB | 0029907 | * | 8/1913 |
| GB | 191930 | | 1/1923 |
| WO | WO 2001/25100 | | 4/2001 |
| WO | WO 2001/79068 | | 10/2001 |

* cited by examiner

FIG. 3b
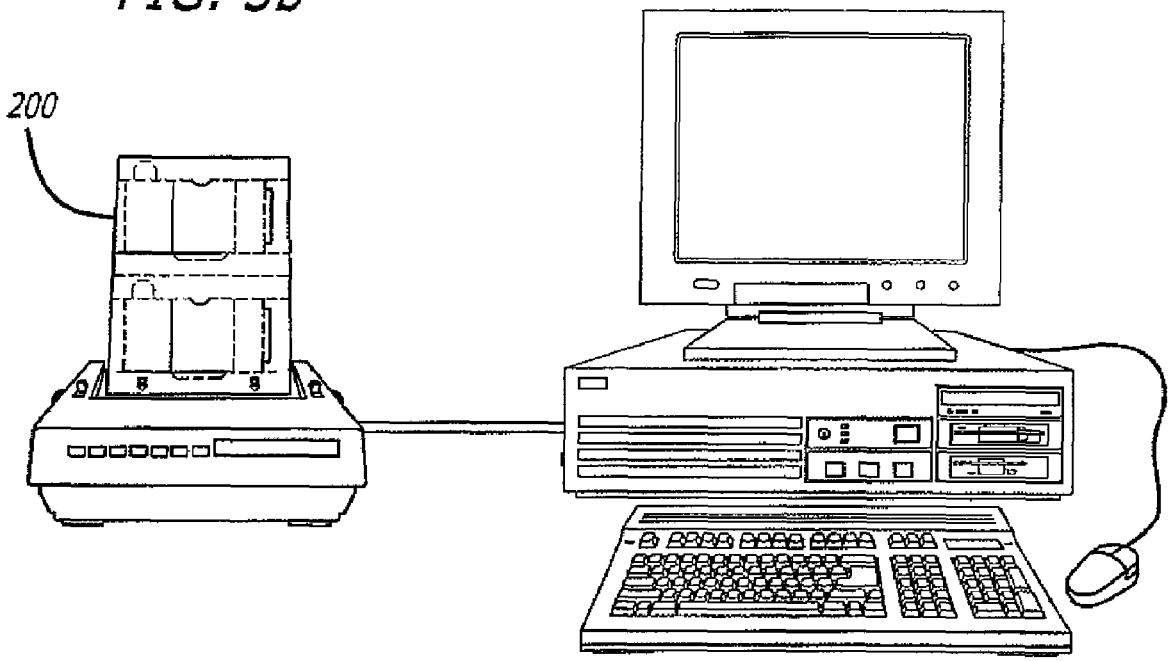
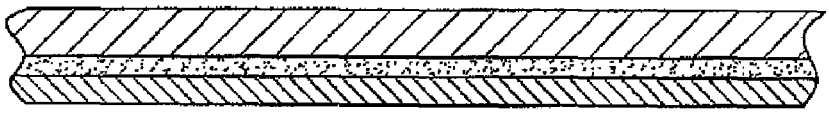
FIG. 3c

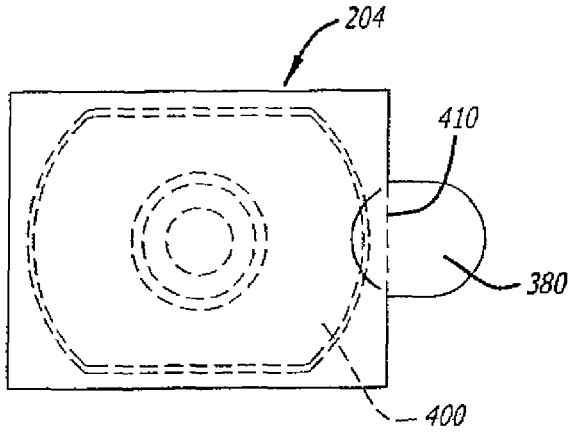
FIG. 12
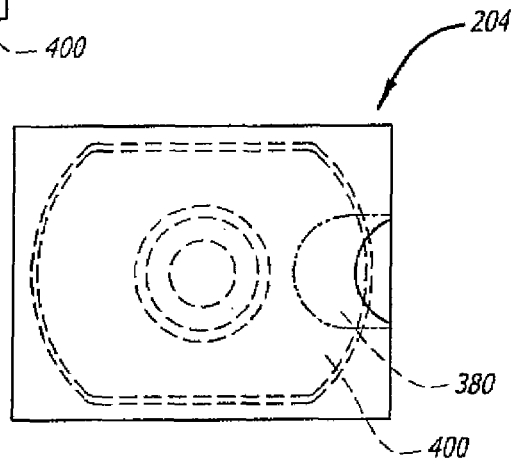
FIG. 13
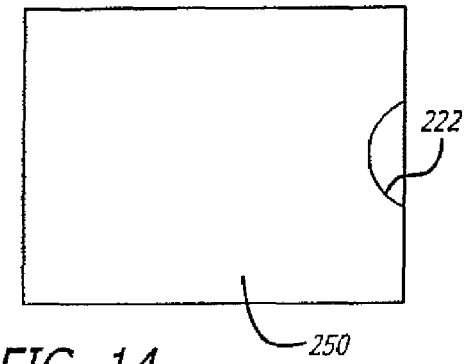
FIG. 14
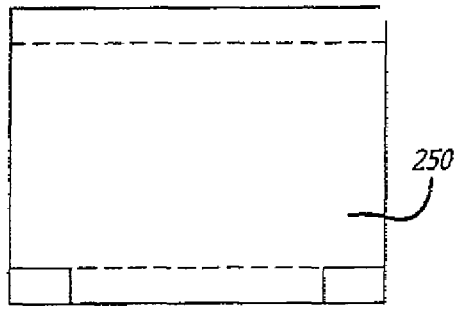
FIG. 15
FIG. 16
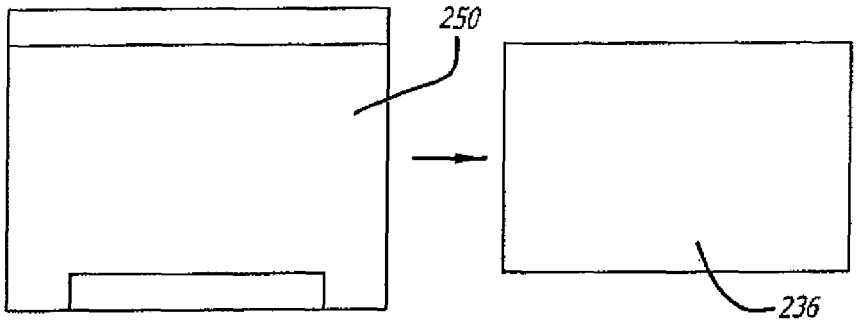

PRINTABLE ENVELOPE WITH REMOVABLE BUSINESS CARD FOR COMPACT DISCS

RELATED APPLICATIONS

This application claims priority from U.S. Provisional Patent Application No. 60/373,851 filed Apr. 19, 2002 and entitled Printable Envelope With Removable Business Card For Compact Discs

BACKGROUND OF THE INVENTION

The present invention relates to an envelope (or pocket) capable of securely packaging or holding various items. Specifically, the present invention relates to a foldable self-adhesive envelope formed on a printable sheet that is capable of receiving items such as compact discs and in particular business card sized compact discs for storage, organization, and transportation Recordable compact discs, and in particular business card sized recordable compact discs are often packaged in bulk, and may have no envelopes or other methods of storage, or they may be stored in a clear plastic envelope. Unfortunately, the plastic often bonds to the surface of the CD, making it difficult to remove from the plastic envelope, and the plastic envelope cannot be printed with any supplemental information. Business card sized compact discs are often used as a sales or promotional tool, so there is a need to have a method of protecting the compact discs that allows for the communication of additional information. Foldable, printable envelopes therefore provide a solution to these needs. The prior art includes numerous envelopes that are capable of securely packaging various items.

An example of a prior art envelope 100 for business card compact discs is shown in FIGS. 1 and 2. The envelope 100 in FIG. 1 has been separated along a perforated line outline from a support sheet (not shown). It is separated preferably after the sheet has been passed through a printer or copier and desired indicia printed on the envelope 100. After separation the bottom panel 104 is folded up along the bottom fold line 108 to the top panel 112. The backside protective strips are removed exposing the adhesive on the side flaps 120, 124. And the side flaps 120, 124 are then folded over onto the bottom panel 104. A pocket for a business card CD is thereby formed.

SUMMARY OF THE INVENTION

There is a need though for not only protecting and identifying compact discs, and in particular business card sized compact discs, but also for providing supplemental information with the compact disc when being used as a promotional or sales tool. For example, a person who wishes to promote a particular business venture may choose to prepare a presentation in electronic format and record the presentation on a business card sized compact disc. If the person then gives the compact disc to a potential customer or investor with a separate loose business card, the business card may become separated from the compact disc and valuable contact information could be misplaced.

Thus, an object of the present invention is to supply a means to provide a decorative and functional protective envelope that includes supplemental information and an integrated business card that remains part of the envelope assembly until the recipient has reached a location where the business card may be safely removed and filed away.

A further object of the present invention is to provide a business card that has the additional benefit of not only having the look and feel of a typical business card when in laminate form, but it also may be delaminated and adhered in label form to a visible location for more frequent and pronounced viewing.

A still further object of the present invention is to provide a means of retaining the compact disc within the envelope during handling. This can be by means of a foldable flap which can be tucked into the envelope.

Yet another object of the present invention is to have the envelope initially provided in a format that can be printed in a laser or ink jet printer. This would typically be as a sub-component of an 8½"×11" sheet or an A4 sheet of a paper/adhesive/release-coated liner laminate that can be passed through a common ink jet or laser printer or a copier, with the envelope being capable of being separated from the sheet after it has passed through a printer or copier and custom indicia printed thereon. The sheet may have one, preferably two, or more printable envelopes incorporated into the design of the sheet.

In particular, the present invention provides a printable, foldable envelope with an integrated business card capable of being folded and held together by self-adhesive areas of the foldable envelope- to securely package various items. The present invention includes a sheet on which one or more envelopes with an integrated business card are formed, having weakening lines separating the outline of the envelopes on the sheet. Portions of the envelope have weakening lines on the release-coated liner side of the envelope can be offset from weakening lines on the paper/adhesive layer that facilitate the exposure of pressure sensitive adhesive bonded to the top layer when the envelope is removed from the sheet, or after removal from the sheet. Offset weakening lines may also be used to facilitate the formation of extensions of release liner beyond the general outline of the envelope to provide tabs that may be grasped to further remove one or more sections of release liner after removal of the envelope from the sheet. The sheet is capable of being placed in a printer or copier and having images and/or indicia printed thereon, enabling the envelope to have words or pictures custom designed and printed thereon by the user using his personal computer and printer to describe or augment the envelope's contents. The sheet is perforated or has weakening lines formed so as to allow the sheet to maintain integrity during the manufacturing and printing processes, while allowing the unfolded printed envelope with removable business card to be separated from the sheet without the use of tools. The sheet has creases, scores, die cuts, or perforations to create weakening lines at the locations where folding is to take place.

Prior to folding, the envelope with removable business card includes a rectangular central panel, an end flap, a top panel with exposed adhesive that is configured to bond to the end flap, and a bottom flap with strips of exposed adhesive above and below perforations that outline the top and bottom edges of the removable business card. To form the envelope, the user first folds the end flap toward the liner side then folds the top flap, which bonds to the end flap. Finally, the user folds the bottom flap towards the liner side. The adhesive strip closest to the central rectangular portion bonds to the top flap forming the third side of the envelope, and the adhesive strip on the furthest portion of the bottom flap bonds to the other side of the top flap, capturing the business card portion of the bottom panel between the two adhesive strips. The present invention thereby provides an envelope assembly that combines the protection of an envelope with the benefit of having a removable business card that is an integral component of the assembly.

The indicia (such as images, colors, alphanumerics, designs, etc.) can include a logo, title and/or advertising on the front panel of the envelope pocket, traditional business card-type identifying information (e.g., name, address, phone number, e-mail address, etc.) on the outward side of the detachable third panel and similar or identical identifying information on the outward side of the back panel of the envelope pocket. The same identifying information can be used so that when the business card (all or a substantial part of the third panel) is removed, the information remains fully viewable on the remaining pocket. Of course, other indicia or no indicia at all can be printed on the front, back and third panels. It is anticipated that the indicia that is printed on the envelope and/or business card will be directed to or related to the same person, business entity and/or subject matter as the information contained on the article to be inserted in the envelope pocket. Although the article is preferably a business card sized compact disc, other articles as would be apparent to those skilled in the art can be stored in this pocket or sleeve.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 3*b* shows a conventional printer system printing the printable sheet of FIG(S). 3 (or 17);

FIG. 3*c* is an enlarged cross-sectional view of a portion of the printable sheet of FIG. 3 showing the top paper sheet, the adhesive and the bottom release-coated liner;

FIG. 12 shows the compact disc (in phantom), as it would be inserted into the envelope assembly;

FIG. 13 shows the envelope assembly of FIG. 12 with the retaining flap thereof in the closed retaining position;

FIG. 14 shows the assembled envelope assembly, as it would appear from the primary face after the retaining flap has been closed;

FIG. 15 shows the envelope assembly of FIG. 14, as it would appear from the business card side, after the retaining flap has been closed;

FIG. 16 shows the envelope assembly of FIG. 15 and the business card after having been removed from the envelope;

DETAILED DESCRIPTION OF PREFERRED EMBODIMENTS OF THE INVENTION

Figure 3:
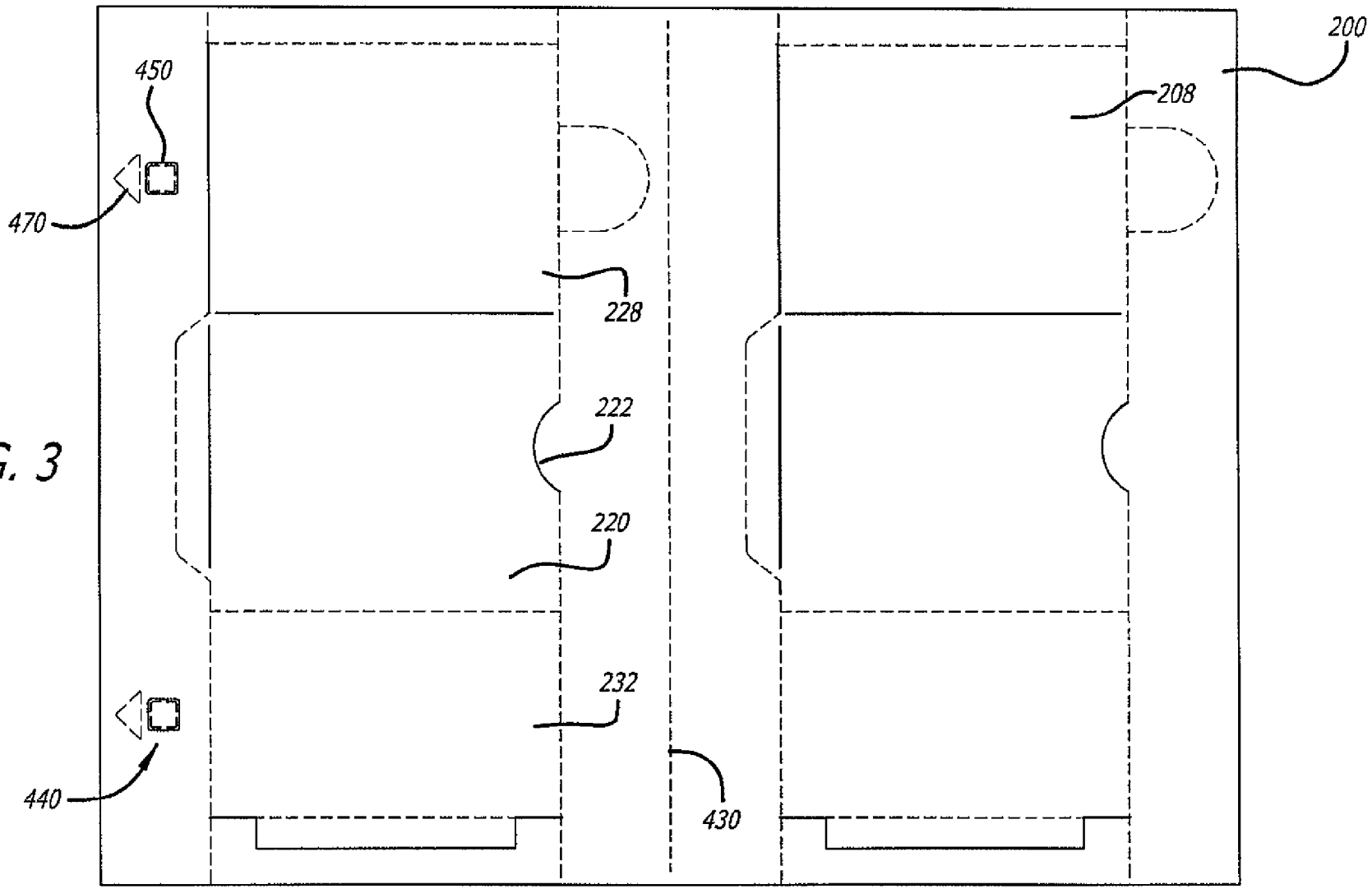
FIG. 3 is a top plan view of a printable sheet of the present invention containing two envelope assemblies with removable business cards.
Figure 3A:
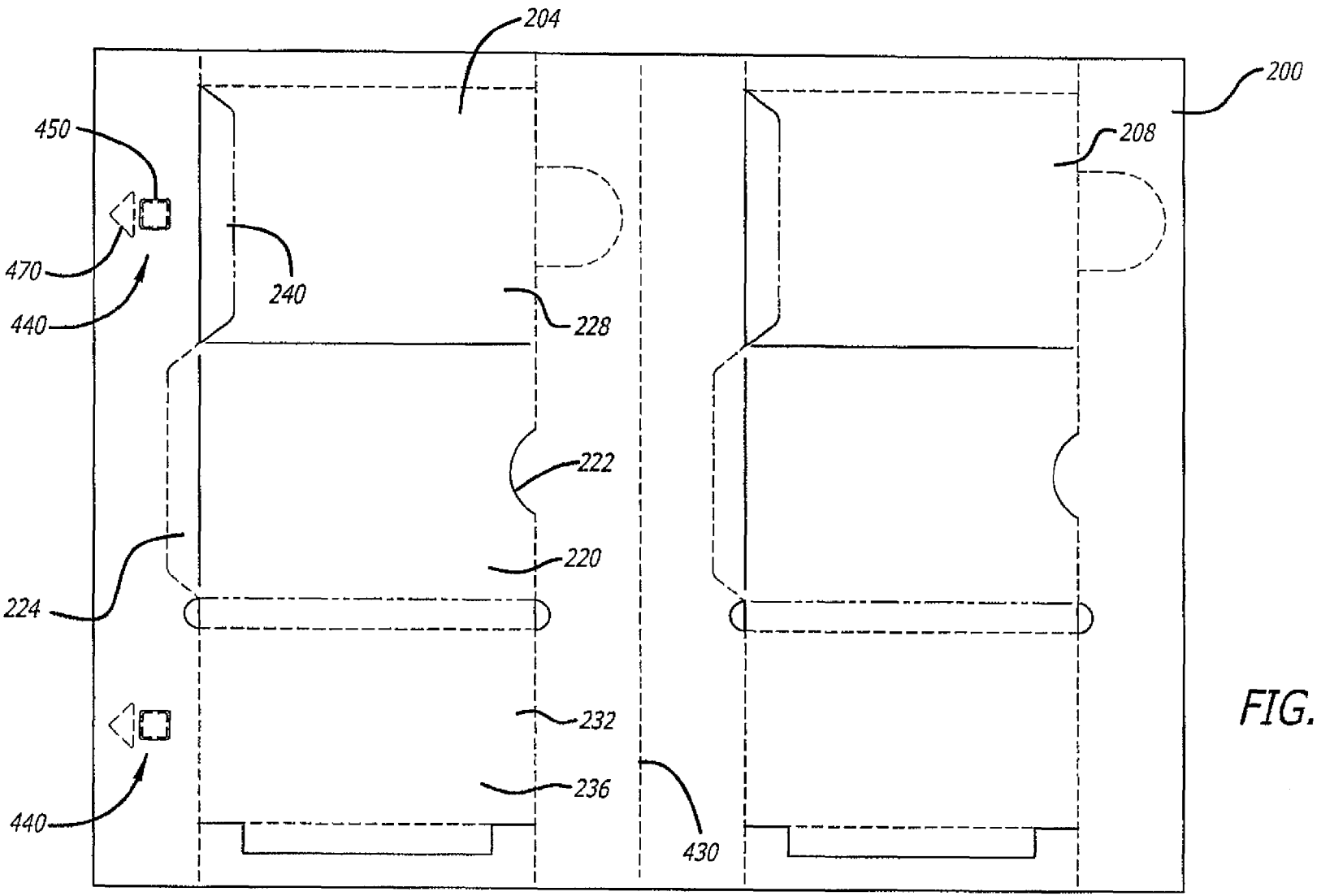
FIG. 3*a* is a view similar to FIG. 3 but as if the sheet were semi-transparent, revealing liner cuts as well as face cuts in order to demonstrate the overall design principles.

Referring to the drawings, FIGS. 3 and 3*a* show a printable sheet (pressure sensitive adhesive laminate sheet) 200 having two preferably identical envelope assemblies 204, 208 formed thereon. The envelope assemblies (business card-Docket lay-outs or pocket-card assemblies) 204, 208 are formed as a sheet or portion on the printable sheet. The perimeters of the envelope assemblies 204, 208 are preferably formed by a combination of offset die cuts and microperforations. The envelope fold lines discussed below can be formed by creases in the sheet, such as by scoring the sheet using a slightly rounded die blade and pressing part way into the sheet to create the score. The envelope assembly 204 includes a central body panel 220. The central body panel 220 is a substantially rectangular portion that is surrounded by a plurality of inter-fitting portions and has a top notch 222. These inter-fitting portions include an end flap 224, a top panel 228, and a bottom panel 232 with an integrated business card 236.

Figure 4:
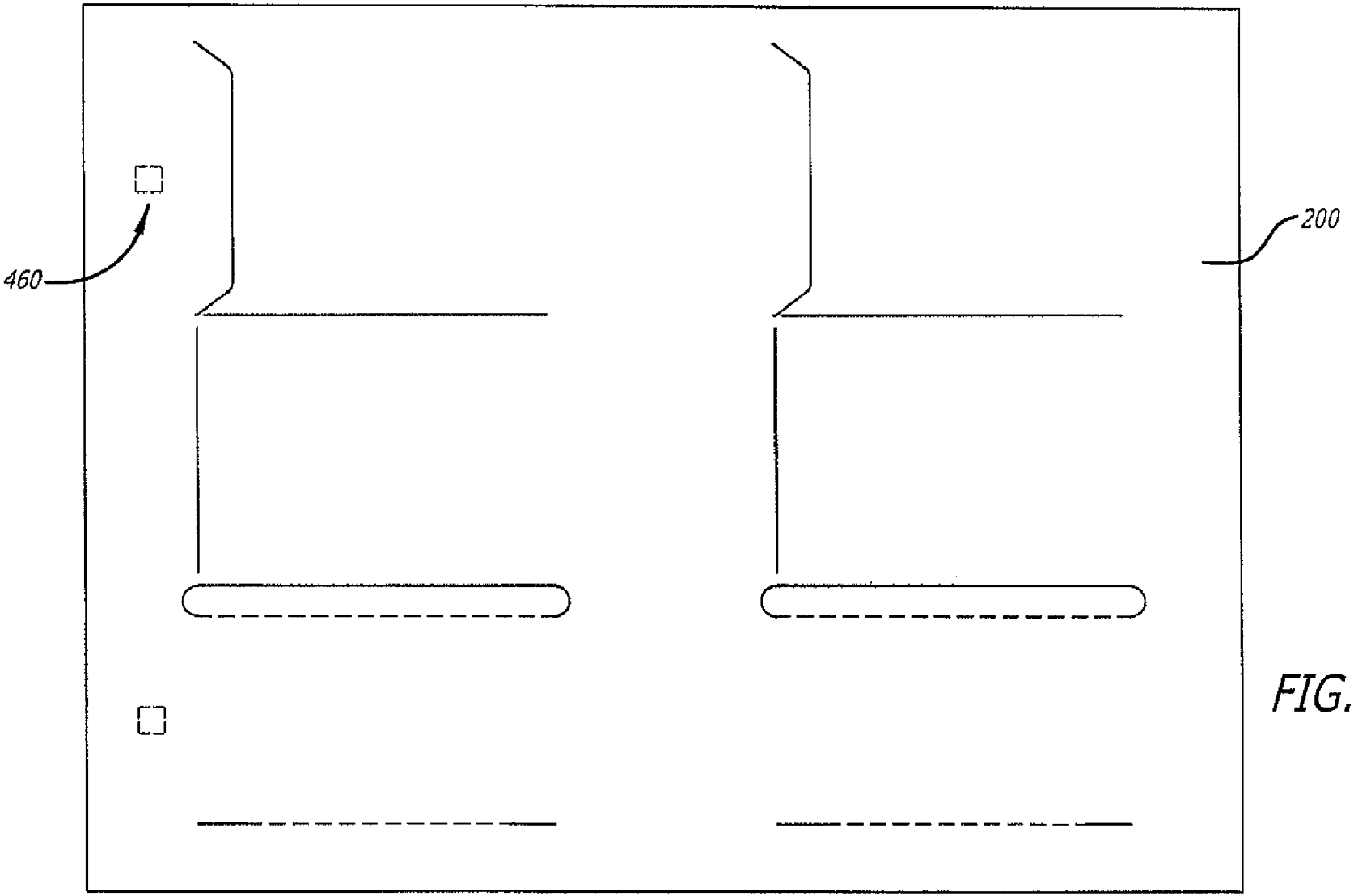
FIG. 4 is a rear plan view of the sheet of FIG. 3.
Figure 6:
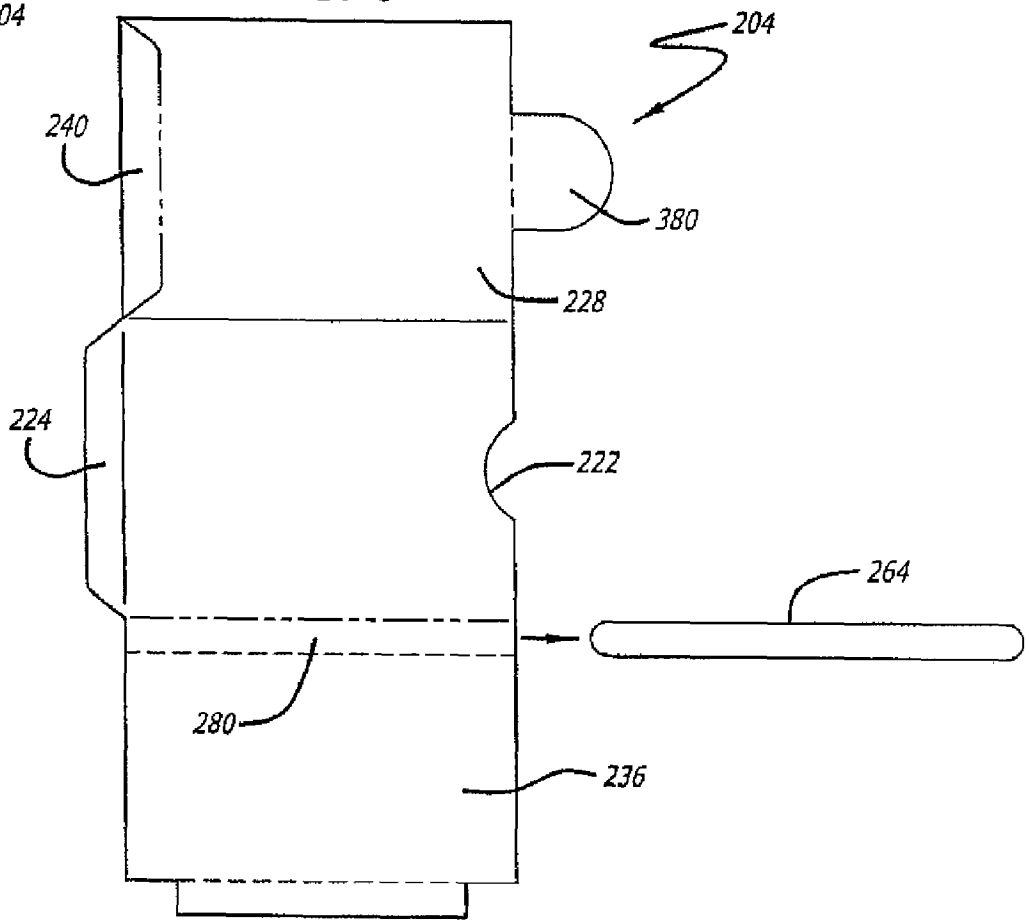
FIG. 6 is a view similar to FIG. 5 showing the removal of a section of liner from the envelope.
Figure 5:
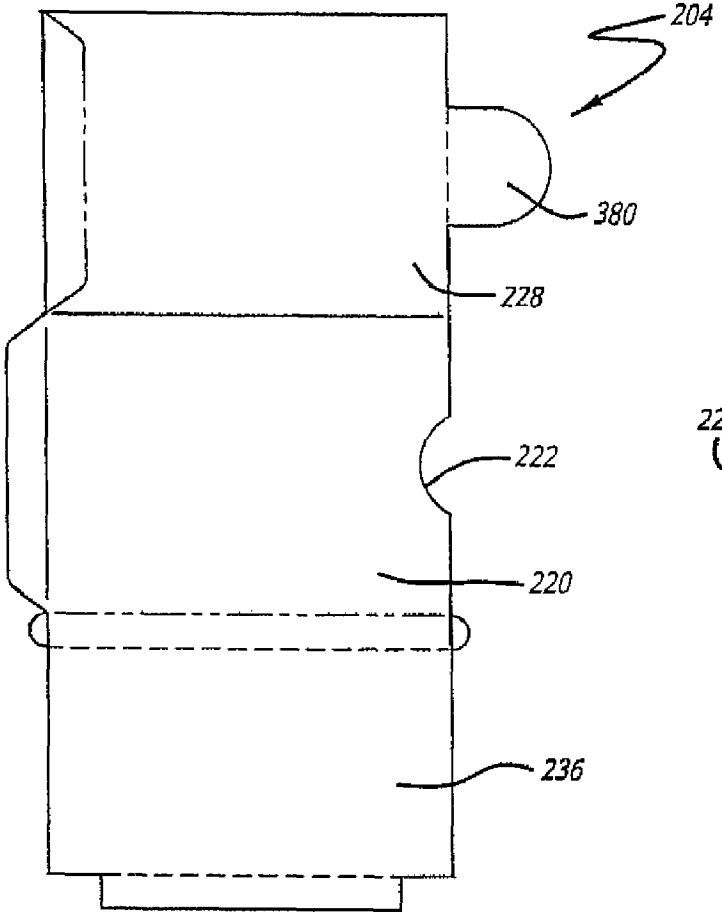
FIG. 5 is a plan view of one unfolded envelope assembly after removal from the sheet of FIG. 3.
Figure 8:
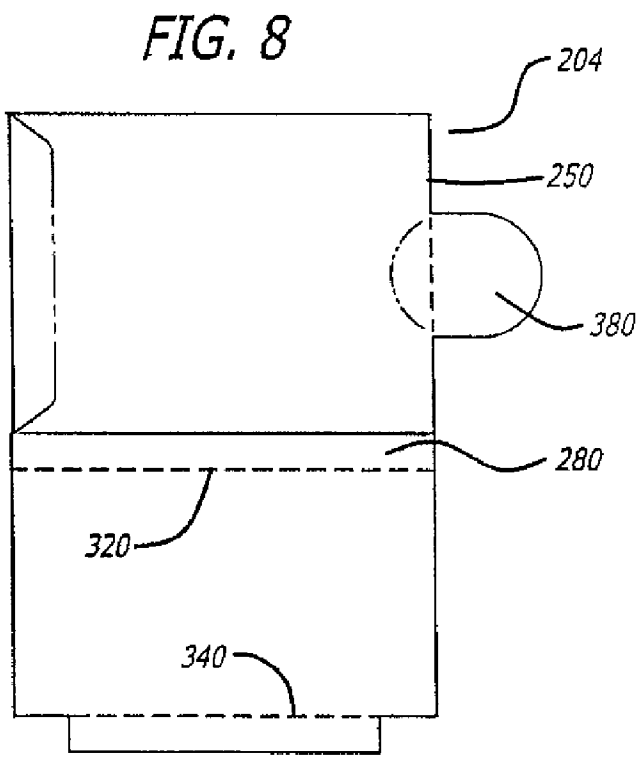
FIG. 8 shows the envelope assembly with the top panel folded down and adhered to the end flap.
Figure 7:
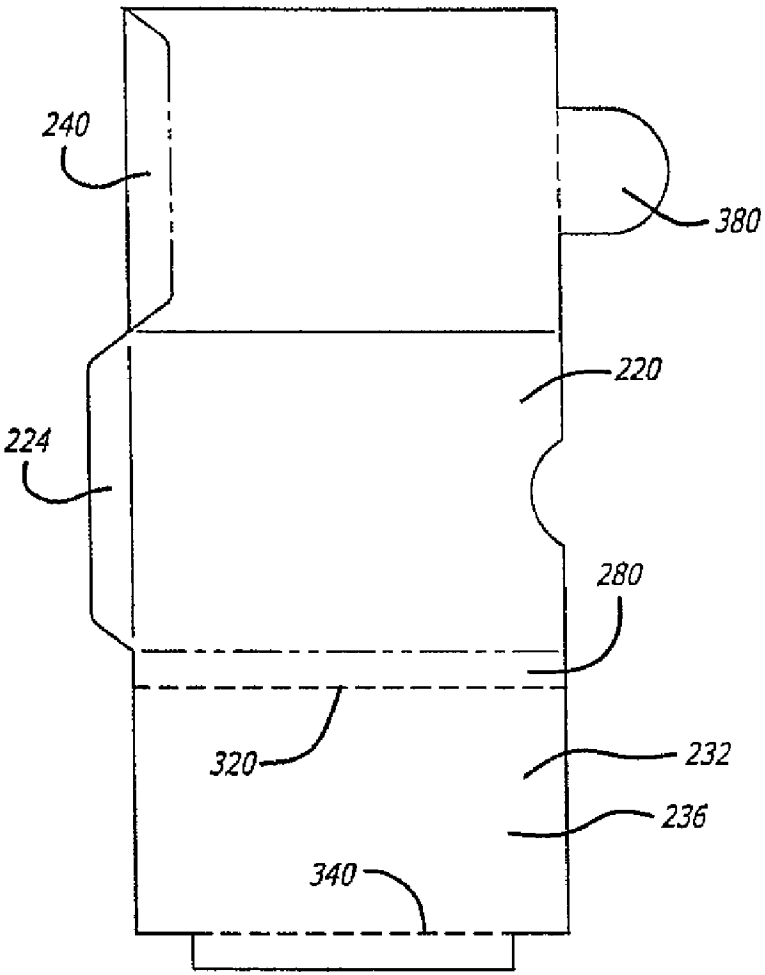
FIG. 7 is a view similar to FIG. 6 showing the end flap folded over as a first step in the folding method.

In a preferred embodiment, when the envelope assembly 204 has been removed from the surrounding sheet 200 as in FIG. 5, (such as after a printing operation by the printer system as shown in FIG. 4 to form a (printed) foldable business card-and-Docket construction), the die cuts in the sheet would be such that the process of separation would expose several areas of adhesive bonded to the paper face material. The top panel 228 would have adhesive exposed in an area 240 that corresponds roughly with the shape and size of the end flap 224. Thus, after the end flap 224 has been folded one hundred and eighty degrees towards the liner as in FIG. 7, the top panel 228 bonds to the end flap when folded down one hundred eighty and degrees on top of the side flap as shown in FIG. 8. This forms the (first) two sides of the envelope or pocket 250. When the bottom panel 232 is folded around the body of the envelope as in FIG. 9, the exposed adhesive area 260 (FIG. 6) closest to the central panel 220 bonds to the edge of the top flap, forming the third side of the envelope 250. The adhesive area 260 is formed, when the liner strip 264 is removed by the user as depicted in FIG. 6. The bottom panel 232 is then placed against the body of the envelope, and the final exposed adhesive area 280 is bonded to the other side of the top panel, capturing the business card 236 between the two adhesive bonded sections.

Figure 9:
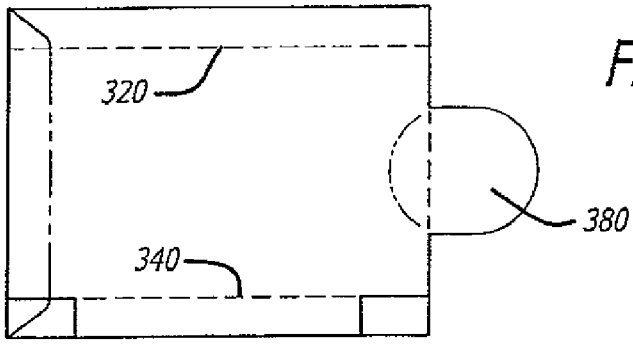
FIG. 9 shows the primary central panel of the envelope being folded down and attached to the bottom flap containing the business card and adhesive strips on the top and bottom of the flap.
Figure 10:
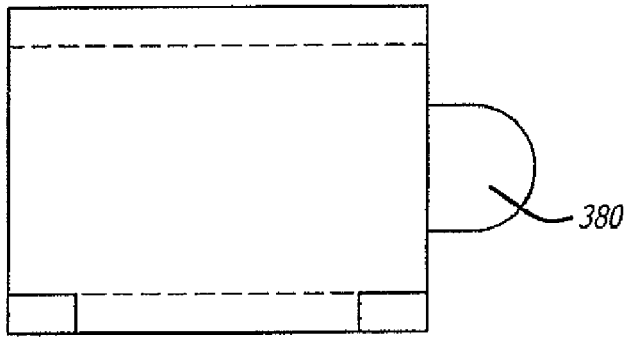
FIG. 10 shows the envelope assembly as it would appear from the business card side after folding is complete.

The preferred embodiment of the business card section 236 has the lower portion die cut in such a way that removal of the perimeter around the envelope removes the liner underneath the lower portion of that flap, exposing the adhesive for further assembly. The liner section between the business card 236 and the body of the envelope 250 can have a continuous die cut on the side adjacent to the body of the envelope, and a perforation on the side adjacent to the business card. It would also have die cuts on the liner extending beyond the edges of the envelope perimeter forming one or two tabs for grasping the liner strip. These tabs would be used after the unfolded envelope has been removed from the sheet to remove the liner in that area, exposing the adhesive to facilitate assembly, as shown in FIG. 6. (FIG. 8 shows a (printed) business card-and-pocket subassembly of the invention. FIGS. 9 and 10 show a (printed) open-end business card-and-pocket assembly of the invention.)

The business card 236 is attached by weakening lines 320, 340, preferably microperforations, to the adhesive exposed sections that were bonded to the body of the envelope 250. The bottom bonded section would preferably be narrower than the business card 236 in order to provide a convenient place to start the removal of the business card, as shown in FIG. 10, from the envelope assembly. By placing a finger under the corner of the business card 236 and lifting in an upward direction, the lower perforation becomes separated, allowing the user to lift and tilt upward the lower portion of the business card. By folding and pulling on the upper perforation 320, the user is able to easily remove the business card 236 from the envelope 250.

Figure 11:
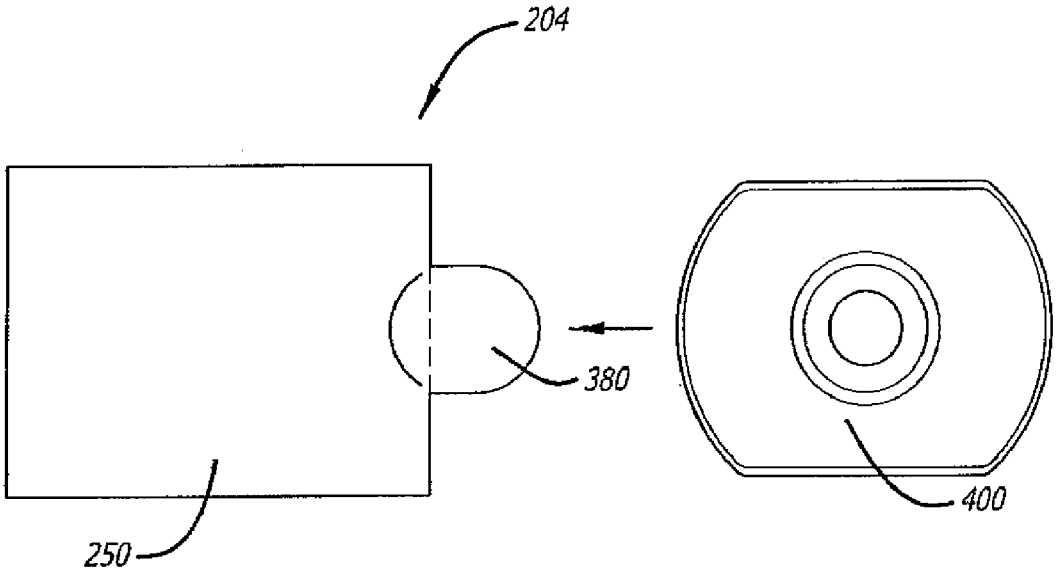
FIG. 11 shows the envelope assembly and a typical business card shaped compact disc ready for insertion therein.

The preferred embodiment would also include a retaining flap 380 that would be folded in over the contents of the envelope 250, preferably a business card sized compact disc 400 (FIG. 11), thereby retaining the contents during handling, as shown in FIGS. 12 and 13. This retaining flap 380 can be connected to the body of the envelope by a perforation line 410 that would facilitate folding, but could also be torn to remove the tab, should the user no longer need it. (FIGS. 13. 14 and 15 show a (printed) closed-end business card-and-pocket assembly of the present invention with an article therein. FIG. 16 shows the (printed) business card (on the right side) separated from the flap-closable pocket (on the left side).)

The preferred embodiment would also have a perforation or other weakening line 430 as shown in FIG. I in the center of the sheet 200 so that it can be folded in half for packaging and sale in order to minimize required retail shelf space for the sheet.

Figure 2:
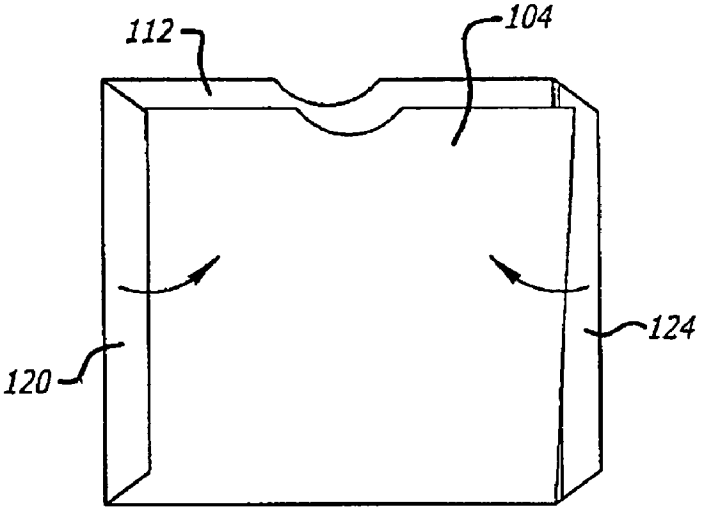
FIG. 2 (Prior Art)
FIG. 2 is a top view of the prior art envelope of FIG. 1 shown being folded to form a pocket.
Figure 1:
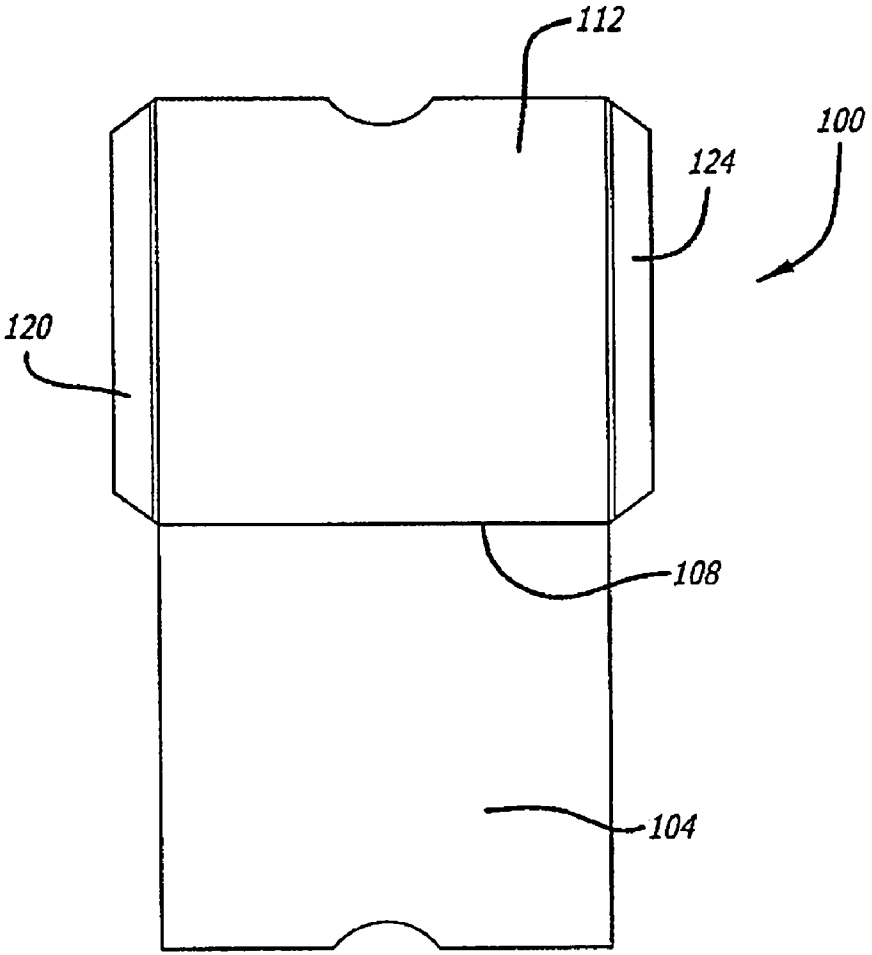
FIG. 1 (Prior Art)
FIG. 1 is a top view of a prior art envelope after having been separated from its support sheet.

The preferred embodiment would also have printed or die cut arrows 440 on one side of the sheet 200 to indicate feed direction into the printers, as seen in FIG 1, since the sheet requires a specific orientation for correctly aligned printing. One portion 450 of the arrow 440, if it is die cut, can be square in shape and have a mating smaller squared die cut perforation 460 on the liner so that, when the top square is removed, is equidistant from each side of the square when properly aligned. This provides a visual cue for alignment during the manufacturing processes. A perforated triangle 470 defines with square 450 the printer-feed directional arrow 440 for the user.

Figure 17:
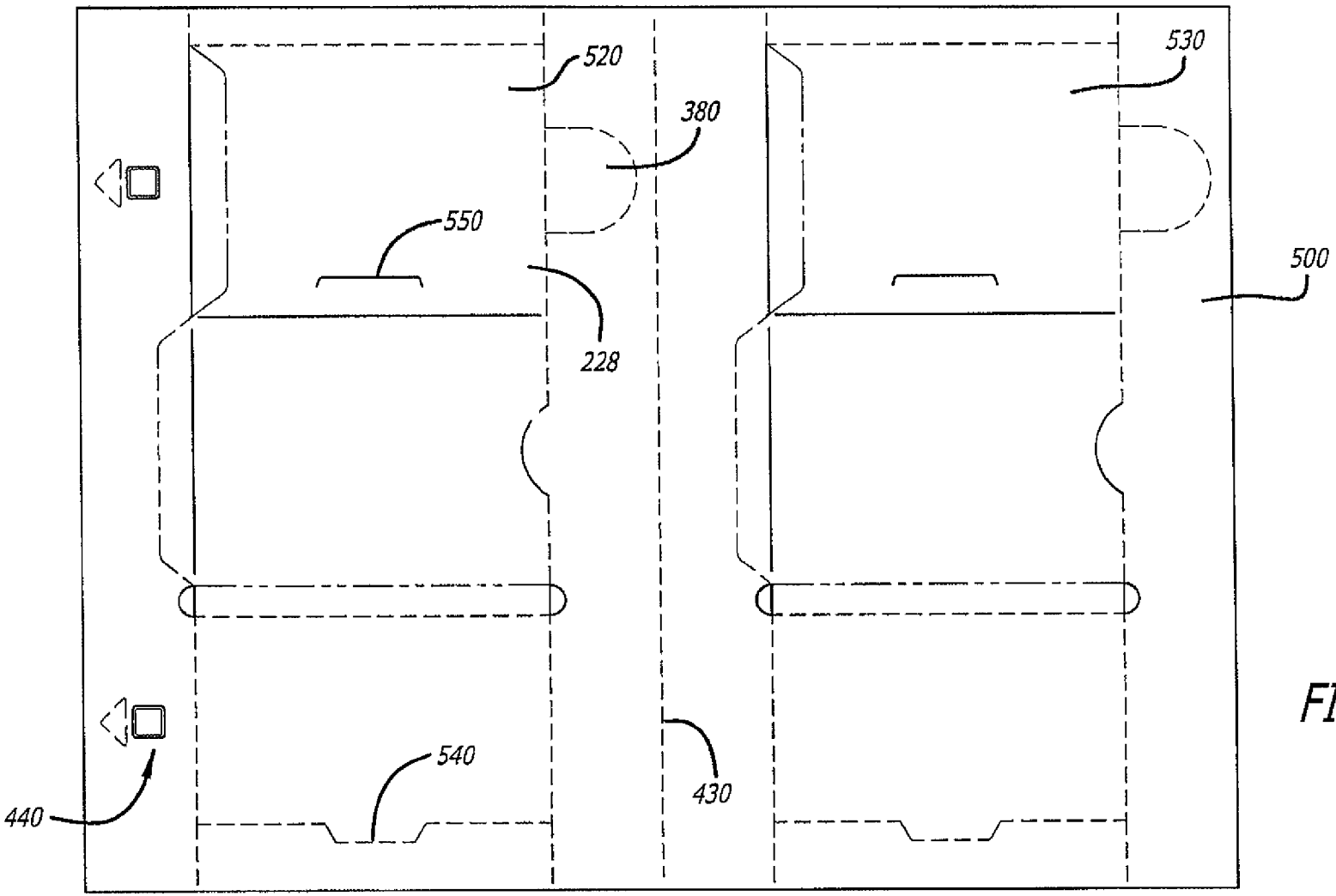
FIG. 17 is a top plan view of a first alternative printable sheet of the present invention containing two envelope assemblies with removable business cards.
Figure 19:
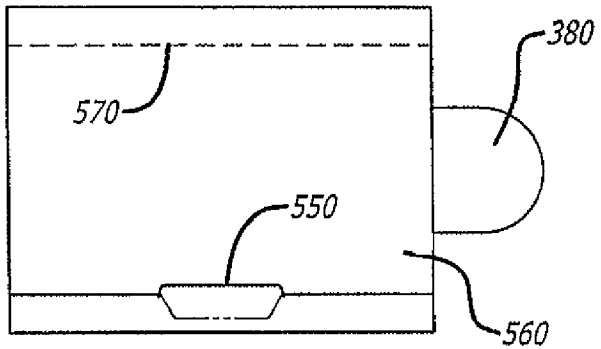
FIG. 19 is a top plan view of the envelope assembly of FIG. 18 in an assembled condition.
Figure 20:
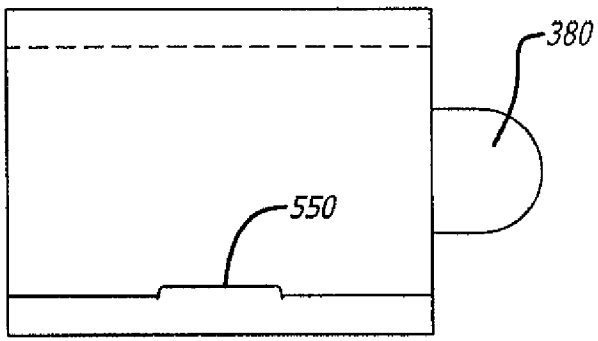
FIG. 20 is another view of the envelope assembly of FIG. 19 as it would appear from the business card side after folding has been completed.

A first alternative sheet 500 with similar or identical envelope assemblies 520, 530 is depicted in FIG. 17. The main difference between envelope assembly 520 and envelope assembly 204 is instead of an adhesive flap to adhere the bottom panel to the envelope or sleeve, a tab-and-slot arrangement is used. This arrangement includes a tab 540, as depicted at the bottom center of FIG. 18, which is adapted to fit into the slot 550 in the top panel 228. Referring to FIGS. 19 and 20, this releasably holds the distal end of the bottom panel (or business card) to the envelope 250.

Figure 21:
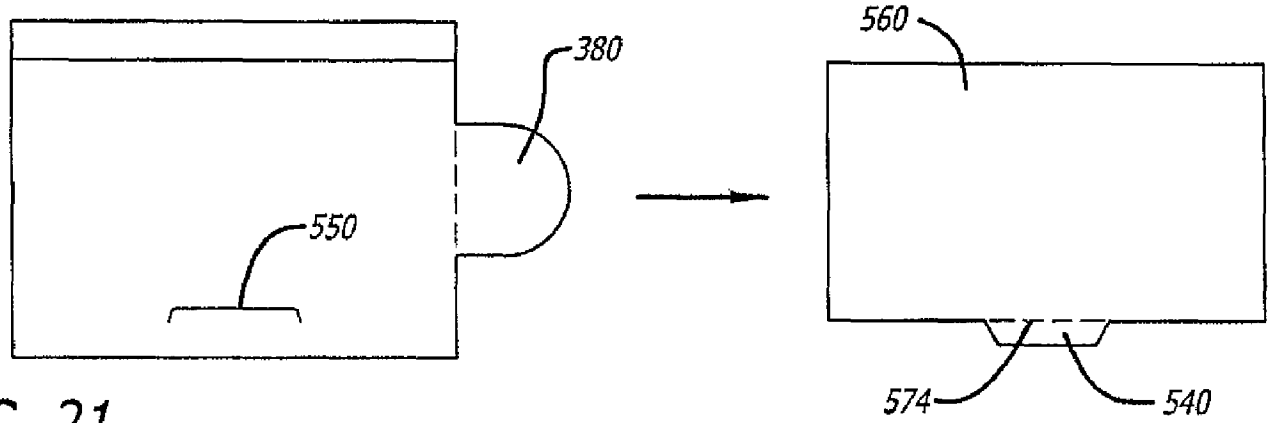
FIG. 21 is a top plan view of the envelope assembly of FIG. 19 with the business card separated therefrom.
Figure 22:
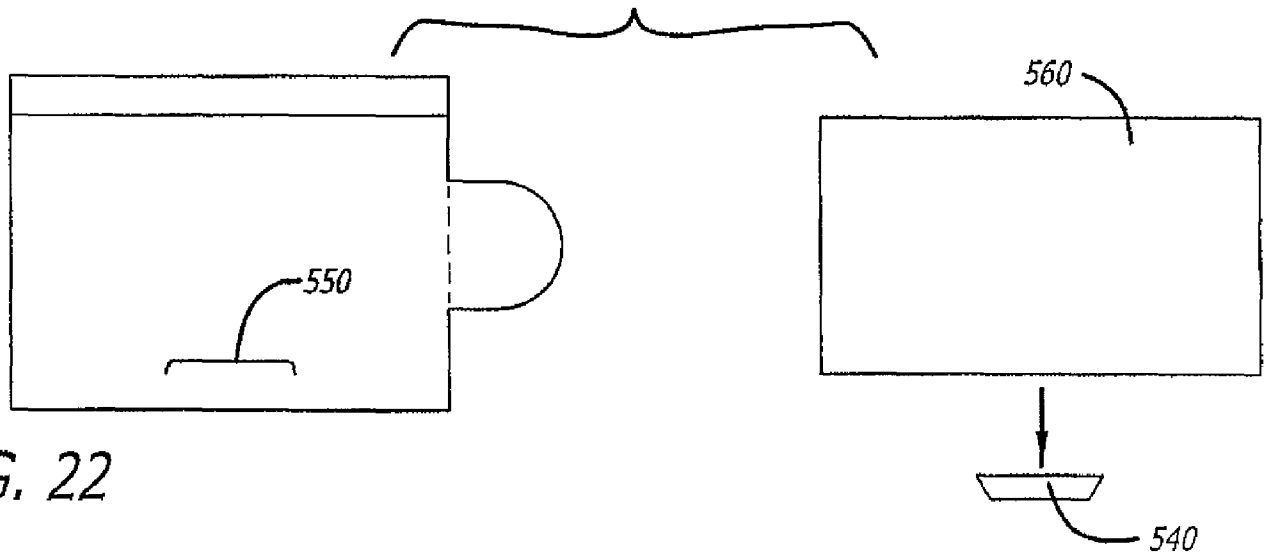
FIG. 22 is a view similar to FIG. 21 showing the tab being separated from the business card.

When the ultimate user wants to separate the business card 560 from the envelope 250 (for storage in his ROLODEX card holder, for example), he pulls the tab 540 out of the slot 550. He then tears the card 560 along the weakened separation line 570 in the bottom panel and separates the card from the envelope or pocket 250, as depicted in FIG. 21. He can then tear the tab 540 off of the removed card along a perforation line shown at 574 in FIG. 21 to form a rectangular card, as illustrated in FIG. 22.

Figure 18:
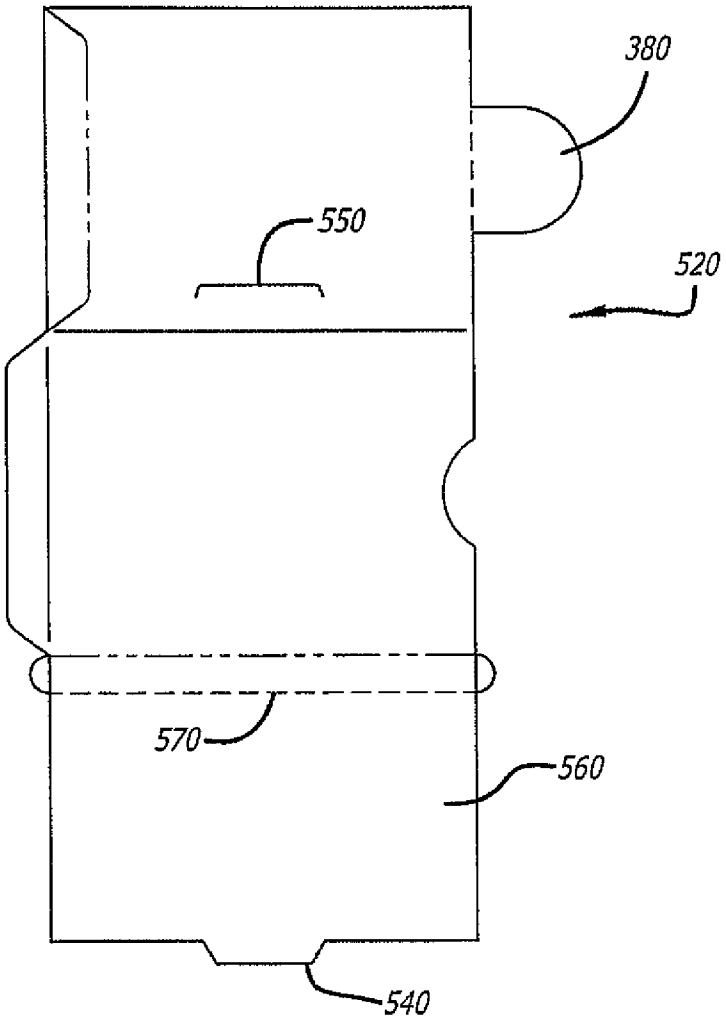
FIG. 18 is a plan view of one unfolded envelope assembly after removal from the sheet of FIG. 17.
Figure 23:
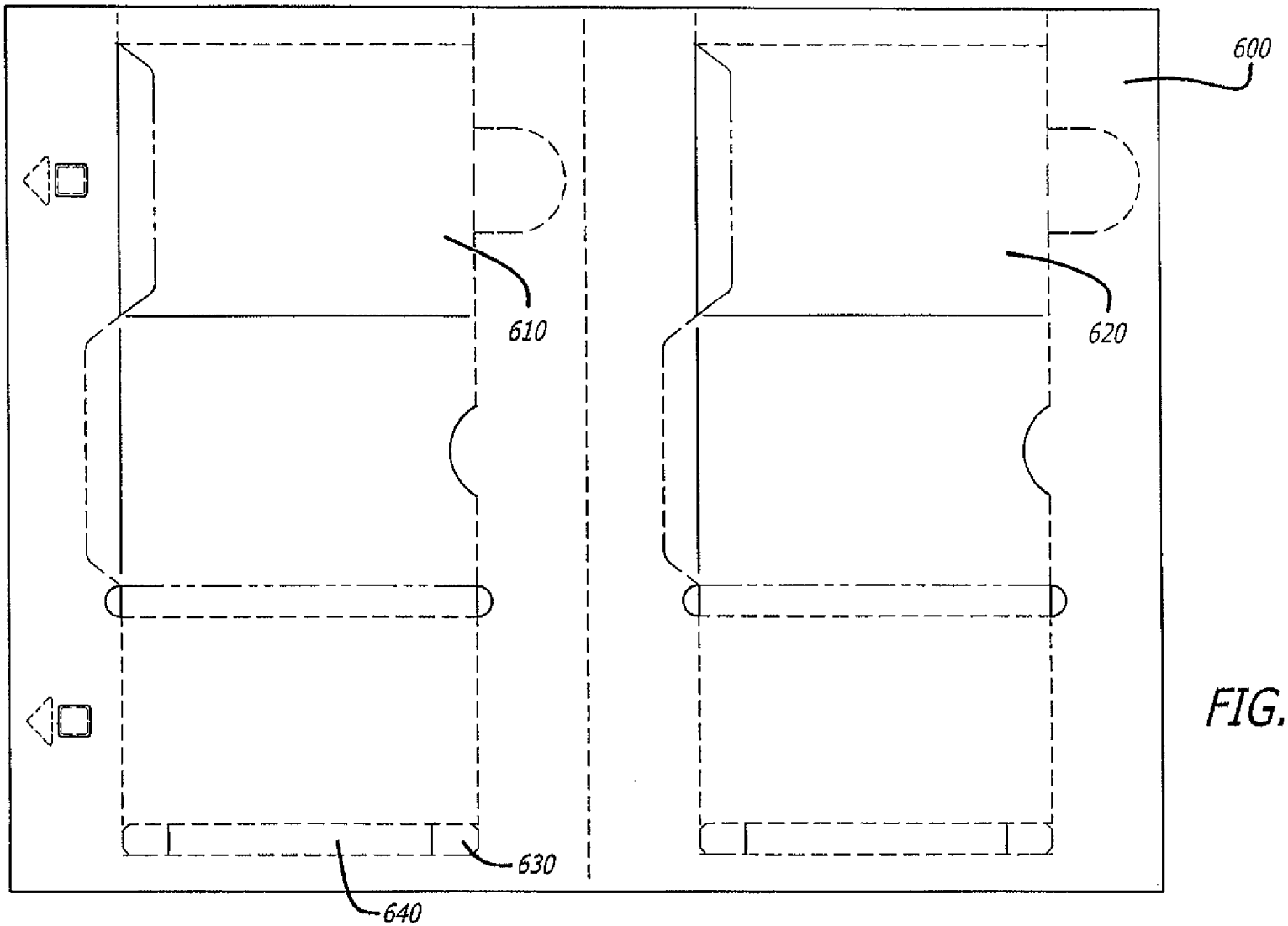
FIG. 23 is a top plan view of a second alternative printable sheet of the present invention containing two envelope assemblies with removable business cards.

A second alternative sheet (pressure sensitive adhesive laminate sheet is depicted in FIG. 23 generally at 600. It also preferably includes two envelope assemblies 610, 620 (business card-pocket lay-outs). Similar to the first alternative, it includes an alternative way to attach the distal end of the bottom panel to the pocket or envelope. In the preferred embodiment, when the envelope assembly is separated from its support sheet (as shown in FIG. 18 to thereby form a (printed) foldable business card-and-pocket construction), the bottom flap is automatically separated from the sheet without the adjacent liner, thereby exposing the adhesive on the flap.

Figure 25:
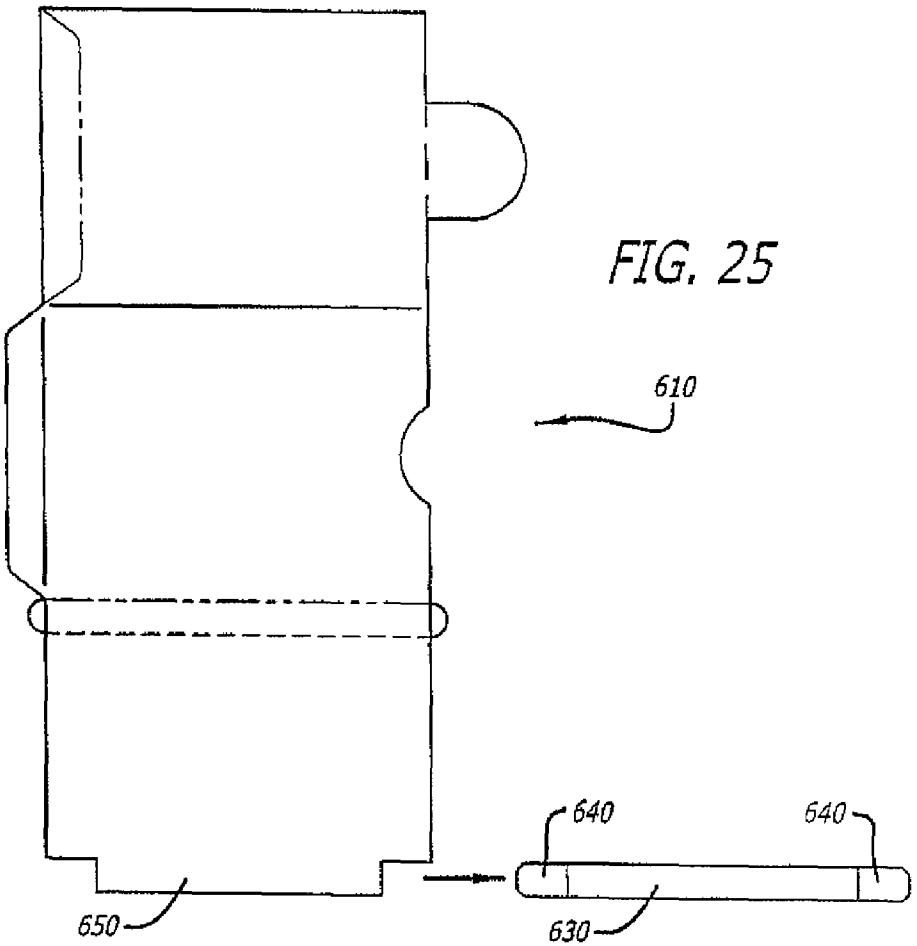
FIG. 25 is a view similar to FIG. 24 showing the adhesive cover strip pulled thereof.
Figure 24:
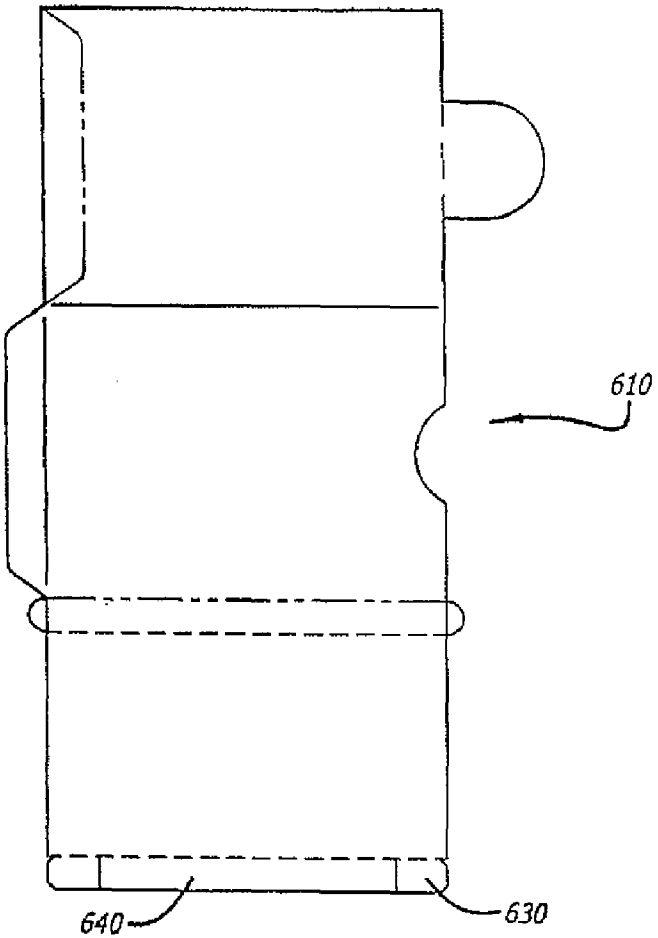
FIG. 24 is a top plan view of one of the envelope assemblies after having been separated from the sheet of FIG. 23.

In contrast, with the sheet 600, when the envelope assembly 610 is separated from the sheet 600, a liner strip 630 attached to the bottom flap 640 is removed with it. The user grasps the tab ends 640 of the strip 630 and removes it, as illustrated in FIG. 25, to expose the flap adhesive 650. This removal can be done before or after the pocket is formed. FIGS. 19 and 20 show a (printed) open-end business card-and-pocket assembly of the invention, which with the flap in a tucked-in position forms a (printed) open-end business card-and-pocket assembly. FIG. 21 shows the (printed) business card (on the right side) separated from the flap-closable rocket (left side) with the flap in an open position. FIG. 22 is a view similar to FIG. 21, showing the tab 540 being removed from the card 560, as discussed above.

From the foregoing detailed description, it will be evident that there are a number of changes, adaptations and modifications of the present invention which come within the province of those skilled in the art. For example, different sheet construction aside from that mentioned herein can be used. The invention includes any combination of the elements from the different species and/or embodiments disclosed herein. However, it is intended that all such variations not departing from the spirit of the invention be considered as within the scope thereof.

The invention claimed is:

1. An envelope assembly comprising:

an envelope with a removable business card attached thereto by weakening lines;

the envelope, in an unfolded form, being incorporated into a sheet;

the envelope being attached to the sheet by weakened lines; and the sheet having at least one triangle and one rectangle die cut into the face, and a smaller perforated rectangle die cut into a liner of the sheet centered within the face cut rectangle, so that the manufacturer can remove the face cut rectangle to check registration of the face and liner die cuts, and the box and triangle will resemble an arrow to an end user that can be used for orientation when preparing for printing.

2. The envelope assembly of claim 1 wherein the weakened lines are at least one of microperforations, die cuts and offset die cuts.

3. A sheet construction, comprising:

a sheet;

a pattern of weakened lines on the sheet, defining an outline of a pocket-card assembly and allowing the assembly to be separated from the rest of the sheet thereby in a separated position after the sheet has been passed through a printer or copier and desired indicia printed on the assembly;

the assembly including a first panel, a second panel, a third panel, a bottom end flap, a first fold line between the first and second panels, a second fold line between the second and third panels, and a third fold line associated with the end flap;

with the assembly in the separated position, the third fold line allowing the end flap to be folded up towards one of the first and second panels into a flap-folded-up position;

with the end flap in the flap-folded-up position, the first fold line allowing at least one of the first and second panels to be folded towards the other in a panel-folded position and the end flap attached to the other of the first and second panels in a flap-attached position;

with the end flap in the flap-attached position, the third fold line allowing the third panel to be folded towards the first panel and attached thereto in a panel-attached position and such that the first and second panels and the end flap at least in substantial part form a pocket having an open top;

with the third panel in the panel-attached position, assembly weakened lines allowing at least a substantial portion of the third panel to be separated from the pocket to form a separate card;

the assembly including a top flap and a fourth fold line associated with the top flap, and with the first and second panels in the panel-attached position, the fourth fold line allowing the top flap to be folded in relative to the pocket at the open top to releasably hold contents in the pocket; and the fourth fold line being a perforated line which allows the top flap to be torn off of the pocket.

4. A sheet construction, comprising:

a sheet;

a pattern of weakened lines on the sheet, defining an outline of a pocket-card assembly and allowing the assembly to be separated from the rest of the sheet thereby in a separated position after the sheet has been passed through a printer or copier and desired indicia printed on the assembly;

the assembly including a first panel, a second panel, a third panel, a bottom end flap, a first fold line between the first and second panels, a second fold line between the second and third panels, and a third fold line associated with the end flap;

with the assembly in the separated position, the third fold line allowing the end flap to be folded up towards one of the first and second panels into a flap-folded-up position;

with the end flap in the flap-folded-up position, the first fold line allowing at least one of the first and second panels to be folded towards the other in a panel-folded position and the end flap attached to the other of the first and second panels in a flap-attached position;

with the end flap in the flap-attached position, the third fold line allowing the third panel to be folded towards the first panel and attached thereto in a panel-attached position and such that the first and second panels and the end flap at least in substantial part form a pocket having an open top;

with the third panel in the panel-attached position, assembly weakened lines allowing at least a substantial portion of the third panel to be separated from the pocket to form a separate card;

the assembly including a top flap and a fourth fold line associated with the top flap, and with the first and second panels in the panel-attached position, the fourth fold line allowing the top flap to be folded in relative to the pocket at the open top to releasably hold contents in the pocket;

the fourth fold line being between the top flap and the first panel;

the top flap defining a top tab; and the second panel including a top tab notch.

5. A sheet construction, comprising:

a sheet;

a pattern of weakened lines on the sheet, defining an outline of a pocket-card assembly and allowing the assembly to be separated from the rest of the sheet thereby in a separated position after the sheet has been passed through a printer or copier and desired indicia printed on the assembly;

the assembly including a first panel, a second panel, a third panel, a bottom end flap, a first fold line between the first and second panels, a second fold line between the second and third panels, and a third fold line associated with the end flap;

with the assembly in the separated position, the third fold line allowing the end flap to be folded up towards one of the first and second panels into a flap-folded-up position;

with the end flap in the flap-folded-up position, the first fold line allowing at least one of the first and second panels to be folded towards the other in a panel-folded position and the end flap attached to the other of the first and second panels in a flap-attached position;

with the end flap in the flap-attached position, the third fold line allowing the third panel to be folded towards the first panel and attached thereto in a panel-attached position and such that the first and second panels and the end flap at least in substantial part form a pocket having an open top;

with the third panel in the panel-attached position, assembly weakened lines allowing at least a substantial portion of the third panel to be separated from the pocket to form a separate card;

the assembly including adhesive means for attaching the third panel in the panel-attached position;

the sheet including a paper sheet and a release-coated liner sheet;

first and second adhesive areas are between the paper sheet and the liner sheet;

the third panel including at least one weakened line in the liner sheet allowing a first portion of the liner sheet to be removed after the sheet has been passed through the printer or copier to thereby expose the first adhesive area; and the third panel including at least one other weakened line in the liner sheet allowing a second portion of the liner sheet to be removed after the sheet has been passed through the printer or copier to thereby expose the second adhesive area.

6. A sheet construction, comprising:

a sheet;

a pattern of weakened lines on the sheet, defining an outline of a pocket-card assembly and allowing the assembly to be separated from the rest of the sheet thereby in a separated position after the sheet has been passed through a printer or copier and desired indicia printed on the assembly;

the assembly including a first panel, a second panel, a third panel, a bottom end flap, a first fold line between the first and second panels, a second fold line between the second and third panels, and a third fold line associated with the end flap;

with the assembly in the separated position, the third fold line allowing the end flap to be folded up towards one of the first and second panels into a flap-folded-up position;

with the end flap in the flap-folded-up position, the first fold line allowing at least one of the first and second panels to be folded towards the other in a panel-folded position and the end flap attached to the other of the first and second panels in a flap-attached position;

with the end flap in the flap-attached position, the third fold line allowing the third panel to be folded towards the first panel and attached thereto in a panel-attached position and such that the first and second panels and the end flap at least in substantial part form a pocket having an open top;

with the third panel in the panel-attached position, assembly weakened lines allowing at least a substantial portion of the third panel to be separated from the pocket to form a separate card;

the assembly including adhesive means for attaching the third panel in the panel-attached position;

the adhesive means including first and second strips of adhesive; and the assembly including a first weakened line defining a first strip removable to expose the first adhesive strip and a second weakened line defining a second strip removable to expose the second adhesive strip.

7. A sheet construction, comprising;

a pressure sensitive adhesive laminate sheet having weakened lines defining a business card-pocket lay-out;

the business card-pocket lay-out including a first panel, a second panel, a first side edge fold line between the first and second panels, a flap extending out from a bottom edge of one of the first and second panels, a flap fold line along the bottom edge, flap pressure-sensitive adhesive; a weakening line forming a section which may be removed to expose the flap pressure-sensitive adhesive, a third panel, a second side edge fold line between the third panel and the second panel, and a reusable tuck flap;

the third panel including first means for exposing a pressure-sensitive first adhesive section, and second means for exposing a pressure-sensitive second adhesive section;

the third panel including parallel first and second weakened lines defining therebetween a card extending from a top edge to a bottom edge of the third panel;

the sheet being capable of being passed through a printer or copier and a printing operation conducted on the business card-pocket lay-out and thereby the sheet being in a printed condition;

with the sheet in the printed condition, the business card-pocket layout being separable from the sheet to thereby form a printed, foldable business card-and-pocket construction;

the printed, foldable business card-and-pocket construction being capable of being formed as a printed business card-and-pocket subassembly by folding the flap up along the flap fold line, folding the first and second panels on the side edge fold line, and attaching the flap to the exposed pressure-sensitive adhesive on an inside surface of the other of the first and second panels;

the printed business card-and-pocket subassembly being capable of being formed as a printed, open-end business card-and-pocket assembly by folding the third panel on the second fold line towards the first panel, adhering with the pressure-sensitive first adhesive section a first edge portion of the third panel to the first panel, and adhering with the pressure-sensitive second adhesive section a second edge portion of the third panel to the first panel;

an open end of the printed, open-end business card-and-pocket assembly being disposed generally perpendicular to the first and second weakened lines;

the tuck flap being foldable into an open end of the printed, open-end business card-and-pocket assembly to form a printed, closed-end business card-and-pocket assembly; and the card being separable from the printed, closed-end business card-and-pocket assembly or the printed, open-end business card-and-pocket assembly along the first and second weakened lines on the third panel, to form a flap closable pocket and a printed business card separate from the flap closable pocket.

8. A method of producing an envelope assembly, comprising:

providing pressure sensitive adhesive laminate a sheet having an envelope assembly formed thereon;

the envelope assembly including (1) first and second panels adapted to form at least in substantial part an envelope, and (2) a third panel connected to the envelope;

separating the envelope assembly from the sheet; folding and attaching the first and second panels to at least substantially form the envelope;

attaching the third panel to a face of the envelope;

after the attaching the third panel, removing at least a substantial portion of the third panel from the envelope to define a separate article; and delaminating the article to form an adhesive label.

9. A method of producing a printed business card and a pocket, comprising;

passing through a printer or copier a pressure-sensitive adhesive laminate sheet having weakened lines defining a business card-pocket lay-out;

the business card-pocket lay-out including a first panel, a second panel, a first side edge fold line between the first and second panels, a flap extending out from a bottom edge of one of the first and second panels, a flap fold line along the bottom edge, flap pressure-sensitive adhesive, a third panel, a second side edge fold line between the third panel and the second panel, pressure-sensitive first adhesive, pressure-sensitive second adhesive, and a tuck flap;

the third panel including parallel first and second weakened lines defining therebetween a card extending from a top edge to a bottom edge of the third panel;

the passing including printing indicia on the business card-pocket lay-out including on the card and thereby the sheet being in a printed condition;

with the sheet in the printed condition, separating the business card-pocket layout along the weakened lines from the sheet to form a printed, foldable business card-and-pocket construction;

folding the first and second panels of the printed, foldable business card-and-pocket construction on the side edge fold line, folding the flap along the flap fold line and attaching the flap with the flap pressure-sensitive adhesive to an inside surface of the other of the first and second panels to form a printed business card-and-pocket subassembly;

folding the third panel of the printed business card-and-pocket subassembly on the second fold line towards the first panel, adhering with the pressure-sensitive first adhesive a first edge portion of the third panel to the first panel, and adhering with the pressure-sensitive second adhesive a second edge portion of the third panel to the first panel to form a printed, open-end business card-and-pocket assembly;

the printed, open-end business card-and-pocket assembly having an open end disposed generally perpendicular to the first and second weakened lines;

folding the tuck flap into the open end of the printed, open-end business card-and-pocket assembly to form a printed, closed-end business card-and-pocket assembly; and separating the card from the printed, closed-end business card-and-pocket assembly along the first and second weakened lines on the third panel to form a flap-closable pocket and a printed business card separate from the flap-closable pocket.

10. The construction of claim 9 wherein the second weakened line forms a tab removable from the printed business card.

* * * * *